United States Patent [19]

Graft et al.

[11] Patent Number: 4,655,007

[45] Date of Patent: Apr. 7, 1987

[54] HONING APPARATUS

[75] Inventors: Richard P. Graft, Angola; Gary I. Smith, Auburn, both of Ind.

[73] Assignee: Brammall, Inc., Angola, Ind.

[21] Appl. No.: 874,462

[22] Filed: Jun. 16, 1986

[51] Int. Cl.[4] ..... B24B 33/02

[52] U.S. Cl. ..... 51/338; 51/346

[58] Field of Search ..... 51/59 R, 330, 331, 338, 51/339, 340, 343, 344, 346, 352, 353, 355

[56] References Cited

U.S. PATENT DOCUMENTS

| | | | |
|---|---|---|---|
| 2,727,341 | 12/1955 | Fisher | 51/331 |
| 2,813,383 | 11/1957 | La Jeunesse | 51/346 |
| 2,823,498 | 2/1958 | Saunders | 51/346 X |
| 3,645,050 | 2/1972 | Croll et al. | 51/338 |
| 3,995,400 | 12/1976 | Gillette | 51/338 |
| 4,179,855 | 12/1979 | Gillette . | |

FOREIGN PATENT DOCUMENTS

| | | | |
|---|---|---|---|
| 267922 | 12/1927 | United Kingdom | 51/344 |

OTHER PUBLICATIONS

Horizontal Honing Equipment from Century.

Delapena Honing Equipment, Pub. No. 1/gen/77.

Natco-National Automatic Tool Company, Inc., pp. 9-11.

Sunnen Honing Operation and Maintenance Instructions for Model CV-616-Serial Nos. 2001 and up.

*Primary Examiner*—Robert P. Olszewski

*Attorney, Agent, or Firm*—Hill, Van Santen, Steadman & Simpson

[57] ABSTRACT

A honing apparatus which has a multi-diameter honing tool in which a plurality of honing stones are mounted and which can be radially adjusted so as to hone the inside of a bore and wherein a range of adjustment of the tool is possible over a wide range by using one or more mounting spacers and one or more spacers for moving the stone so as to allow bores over a wide diameter range to be honed. Different numbers of honing stones may be mounted on the head as desired.

7 Claims, 6 Drawing Figures

FIG.5
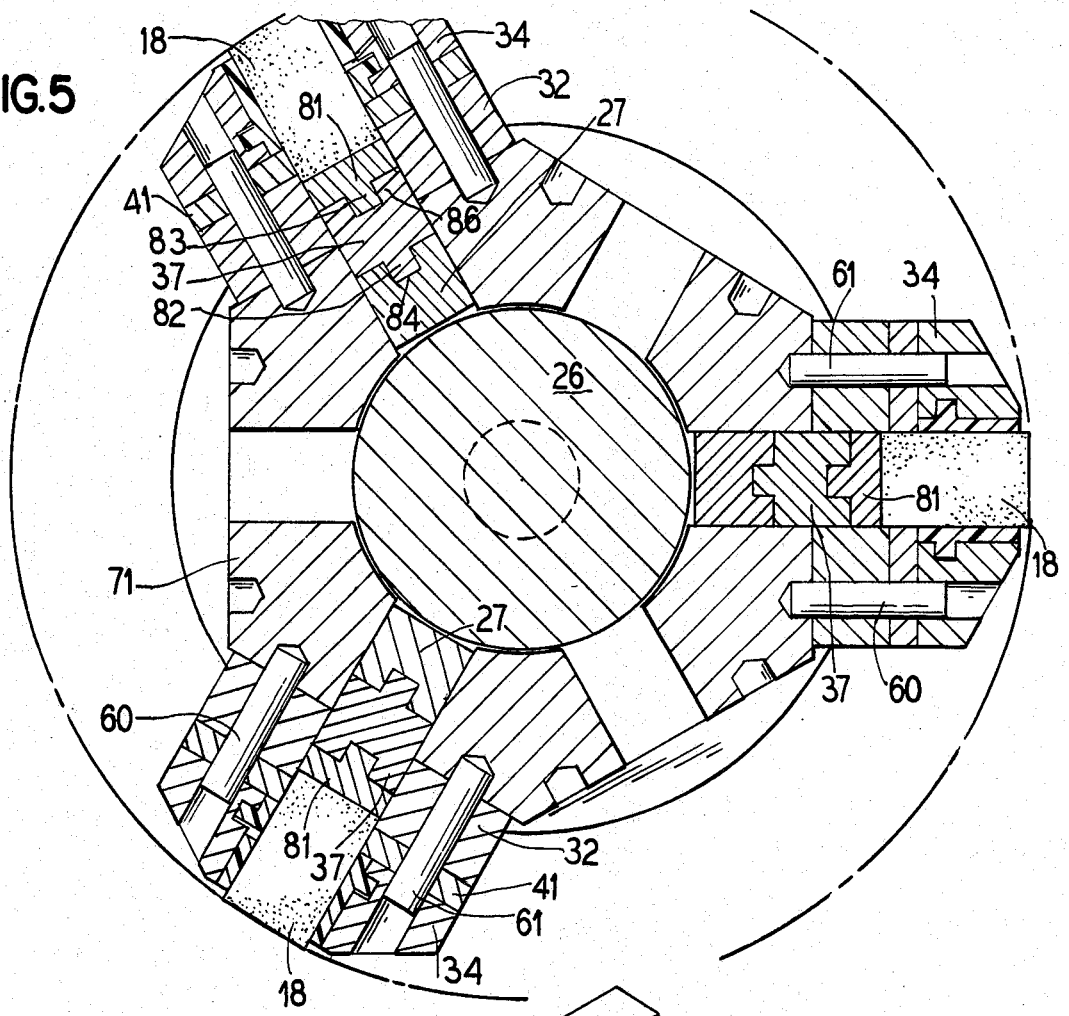
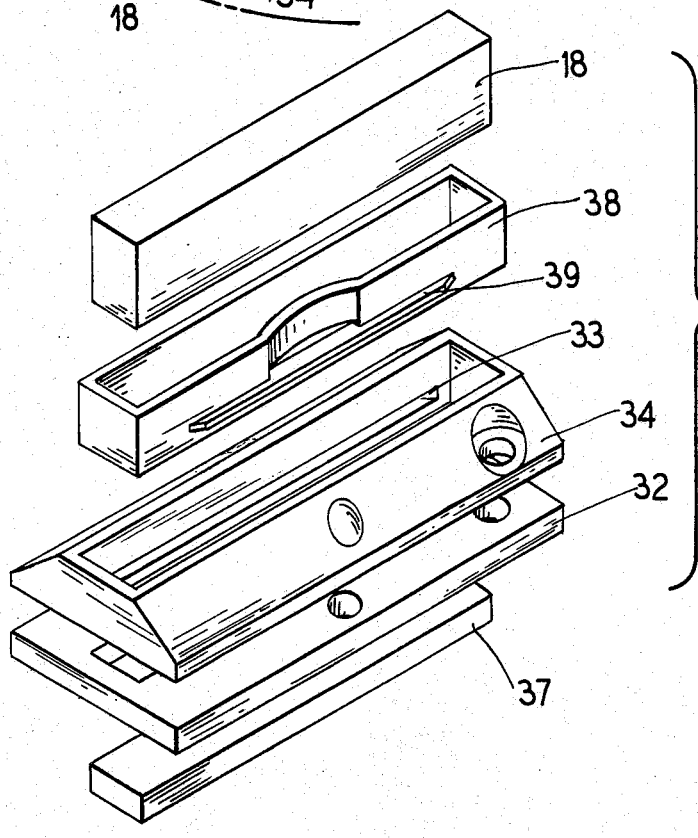
FIG.6

HONING APPARATUS

BACKGROUND OF THE INVENTION

1. Field of the Invention

This invention relates in general to honing apparatus and in particular to honing tools for honing bores of different diameters.

2. Description of the Prior Art

Honing tools are known wherein a generally cylindrical tool holder carries one or more stones which are radially movable relative to the holder by a driving mechanism. However, the honing tools of the prior art can only be adjusted radially within narrow limits which means that a large number of honing tools are required for covering honing jobs of different diameters. U.S. Pat. No. 4,179,855 discloses an insert for a honing tool which illustrates a prior art device wherein the honing tools can be moved radially outwardly from the tool holder.

SUMMARY OF THE INVENTION

The present invention provides a honing tool with one or more honing stones which are radially moveable by an expander mechanism which engages the stone so as to move it radially and wherein one or more spacers may be mounted between the expander and the stone so as to increase the radius of adjustment of the stone and wherein one or more spacers which are formed with a central opening can be mounted between the stone holder and the body of the tool.

The present invention allows the diameter of a honing tool to be adjusted over a broad range as, for example, a range of two inches wherein prior art devices can only be adjusted over a range of one inch in diameter.

The present invention also has a common adjusting component and the abrasive is supported at the working surface of the honing process.

The tool will also function with less than all of the abrasives as, for example, three abrasives may be used rather than six in a six-stone tool. The heads of the invention will adapt to a majority of the honing machines generally used in the honing industry.

A feature of the present invention is to provide a honing tool which allows adjustment over a wide diameter range and, thus, allows a single tool to be used where a number of tools are required in prior art devices to cover the same diameter range.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 5 is a sectional view illustrating three honing stones in use on a tool; and FIG. 6 is an exploded view illustrating the honing stone and holder and flexible holder and spacer members.

DESCRIPTION OF THE PREFERRED EMBODIMENTS

Figures 1, 2, 3, 4:
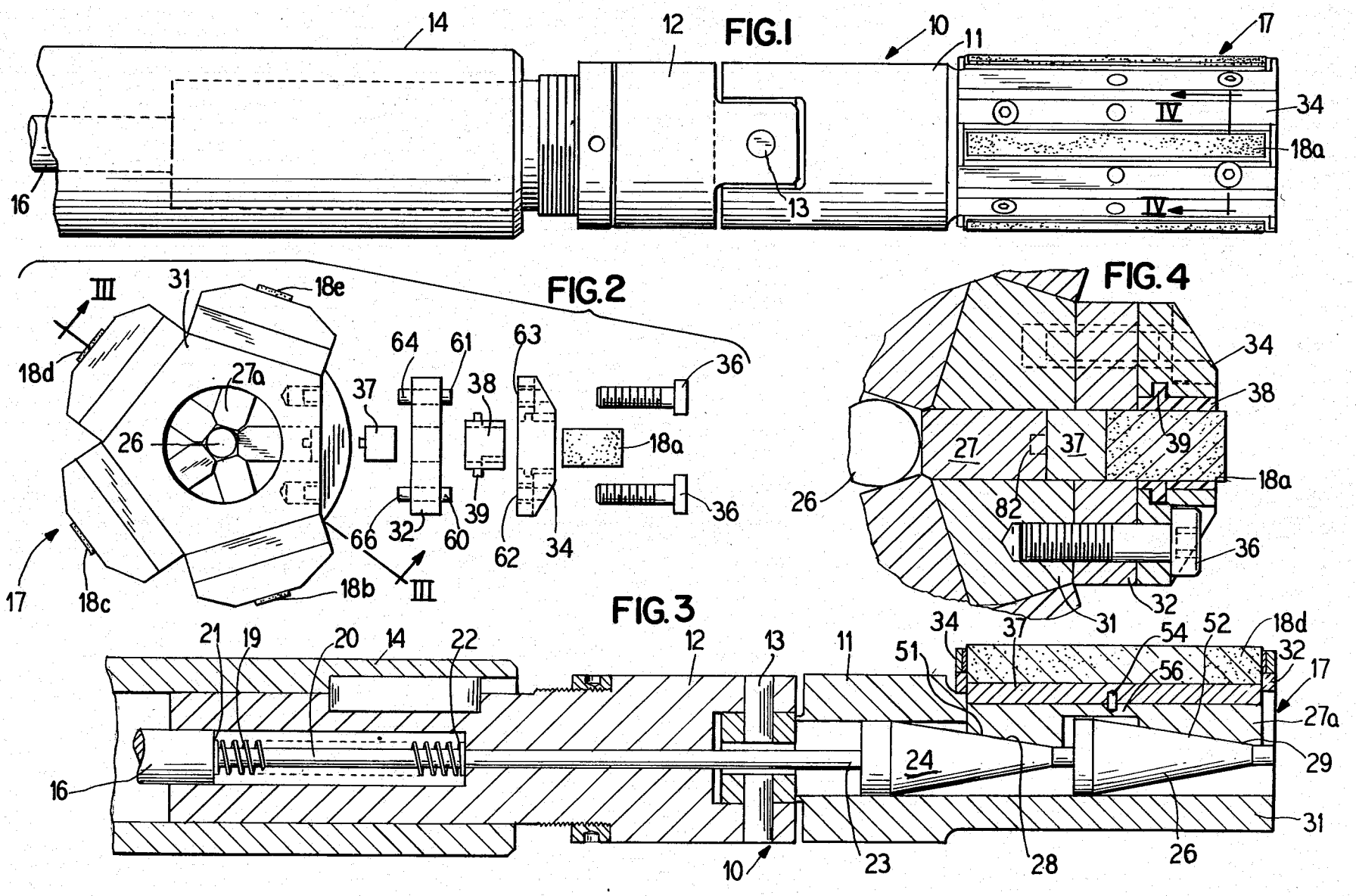
FIG. 1 is a side elevational view of the tool of the invention.
FIG. 2 is a partially exploded end view of the tool of the invention.
FIG. 3 is a sectional view of the tool illustrated in FIG. 1.
FIG. 4 is a sectional view taken on line IV—IV from FIG. 1.

FIGS. 1 and 3 illustrate a honing tool 10 which has a first cylindrical member 11 which is connected by a pin 13 to a second cylindrical portion 12 which is connected to a cylindrical portion 14. The member 11 carries the honing tool 17 in which are mounted a plurality of honing stones such as 18*a* through 18*e* as illustrated in FIG. 2. The honing stones 18 are respectively mounted in honing stone holders 34 and are held therein by flexible stone holder members 38 which have extensions 39 that are received in mating openings 33 formed in the stone holder 34. The end 23 of rod 16 is connected to first and second expanders 24 and 26 which can be moved axially of the tool 10 by the rod 16. The expanders 24 and 26 are formed with cam surfaces 28 and 29 and which are engageable with mating cam surfaces 51 and 52 of a tool driving member 27. A stone driving spacer 37 which has a guide pin 54 that is receivable in an opening 56 formed in the tool driving member 27 is mounted on the tool driving member 27 and engages the stone 18. A mounting spacer 32 is mounted between the tool body 31 and the tapered stone holder 34 and is formed with a central opening through which the stone moving assembly extends.

Bolts 36 as best shown in FIG. 4 extend through the stone holder 34 and the mounting spacer 32 and are threadedly received in openings in the tool body 31 as illustrated in FIG. 4.

The bolts 36 extend through the tapered stone holder 34 at opposite ends thereof and guide pins 60 and 61 extend from both sides of the mounting spacer member 32 as illustrated in FIG. 2 and the end of pins 60 and 61 are received in associated openings 62 and 63 formed in the tapered stone holder 34 as illustrated in FIG. 2. The opposite ends 64 and 66 of the pins 60 and 61 are received in openings formed in the tool member 31. The pins 60 and 61 are centrally spaced relative to the tapered stone holder 34 and assure alignment of the spacer member 32 and the tool holder member 34.

The tool holder member 31 is formed with a plurality of slots so that a plurality of members 27 and stone spacers 37 and stones 18 can be mounted to move radially outward for adjustment. So as to adjust the radial position of the stones 18, shaft 16 is moved to the right relative to FIG. 3 against the tension of spring 19 which is mounted about a reduced crosssectional portion 20 of shaft 16 between shoulders 21 and 22 and the end 23 of shaft 16 drives members 24 and 26 causing the cam surfaces 28 and 29 to move the member 27*a* radially outward and, thus, moves the spacer member 37 and the associated stone 18 radially outward from the honing tool. The spacers 41 and 32 increase the diameter of the tool by their thickness. In other words, as illustrated in FIG. 4, the thickness of the member 32 is the same as the thickness of the stone spacer 37 and they increase the radius of the stone 18 by their thickness.

As is illustrated in FIG. 2, a plurality of stones and spacer elements can be mounted about the tool body 31 and in the FIG. 2 five honing stones 18*a* through 18*e* are illustrated.

FIG. 5 illustrates another embodiment wherein six honing tools 18 may be mounted to a tool body 71. In the embodiment illustrated in FIG. 5, only three honing stones in associated movement and holding mechanisms are illustrated but it is to be realized that three more honing stones and their associated mounting structure and moving structure could be attached to the tool 71 being spaced alternately between the three stones and stone holders illustrated. In the embodiment illustrated in FIG. 5, in addition to the first spacer member 37, a second spacer member 81 is mounted between spacer member 37 and the stone 18. The spacer members 37 and 81 have projections 82 and 83 which are received in receiving openings 84 and 86. The opening 84 is formed in the pusher member 27 and the opening 86 is formed in the spacer member 37.

FIG. 6 is an exploded view of a stone 18, a stone holder insert 38 and the tapered stone holder 34, as well as the spacer elements 32 and 37.

The spacer elements 32 and 37 and the spacer members 81 and 41 can be constructed in various thicknesses and, for example, if three basic thicknesses are available such as $\frac{1}{8}$ inch, $\frac{1}{4}$ inch, and $\frac{3}{8}$ inches, then the increase in diameter of the tool can be expanded from $\frac{1}{4}$ inch to 2 inches. For example, the $\frac{1}{4}$ inch diameter change can be obtained by using $\frac{1}{8}$ inch on all the tools and since the $\frac{1}{8}$ spacer increases the radius by $\frac{1}{8}$ inch, the diameter would be increased by $\frac{1}{4}$ inch. So as to increase the diameter by 2 inches, two $\frac{3}{8}$ inch spacers and one $\frac{1}{4}$ inch spacer could be used. Alternatively, two $\frac{3}{8}$ inch spacers and two $\frac{1}{8}$ inch spacers could be used to increase the diameter by two inches. Also, four $\frac{1}{4}$ inch spacers could be used to increase the diameter by 2 inches.

It is seen that this invention provides a new and novel tool and although it has been described with respect to preferred embodiments, it is not to be so limited as changes and modifications can be made which are within the full intended scope as defined by the appended claims.

We claim as our invention:

1. A honing tool comprising, a tool body having an outer peripheral surface formed with at least one slot and at least one flat outer surface in said perpheral surface upon which a honing stone can be mounted, an expander mounted in said tool body for longitudinal movement and for engagement with a cam surface of an expander member extending into said slot, a stone driving spacer mounted in said slot and engaged by said expander member so as to move it radially of said tool body, a stone holder formed with a slot in which said honing stone is mounted, and a mounting spacer located between and attached to said flat outer surface of the tool body and to said stone holder and formed with a slot through which said stone driving spacer can be moved.

2. A honing tool according to claim 1 wherein the radial thickness dimension of said mounting spacer and said stone driving spacer are the same.

3. A honing tool according to claim 1 including guide pins and guide openings connecting said mounting spacer and said stone holder so as to maintain the alignment of said stone with said tool.

4. A honing tool according to claim 1 including another stone driving spacer mounted between said stone and said spacer and another mounting spacer mounted between said tool body and stone holder to increase the diameter of the honing tool.

5. A honing tool according to claim 1 including a flexible stone holder member mounted in said stone holder and said stone received therein.

6. A honing tool according to claim 1 wherein a plurality of honing stones and associated stone driving spacers, are movable in a plurality of said slots and a plurality of stone holders and mounting spacers are mounted to a plurality of said flat surfaces in the outer periphery of said tool body and said expander with a plurality of expander members is engageable to simultaneously move said stones radially of said tool body.

7. A honing tool according to claim 6 wherein said number of honing stones, stone driving spacers, stone holders and mounting spacers mounted to said tool body are less than the total number of slots in the tool body.

* * * * *